United States Patent [19]
Reese
[11] 4,382,586
[45] May 10, 1983

[54] METAL COOLING BED FOR CONTROLLING RATE OF COOLING

[76] Inventor: Thurston F. Reese, 3324 McClure Bridge Rd., Diluth, Ga. 30136

[21] Appl. No.: 133,520

[22] Filed: Mar. 24, 1980

Related U.S. Application Data

[63] Continuation-in-part of Ser. No. 904,858, May 15, 1978, abandoned.

[51] Int. Cl.³ ..... C21D 1/84
[52] U.S. Cl. ..... 266/259
[58] Field of Search ..... 266/259, 260, 249; 148/13, 155, 156

[56] References Cited

U.S. PATENT DOCUMENTS 3,320,101 5/1967 McLean et al. ..... 148/156
3,930,900 1/1976 Wilson ..... 148/156

*Primary Examiner*—R. Dean
*Attorney, Agent, or Firm*—Beaman & Beaman

[57] ABSTRACT

The invention pertains to method and apparatus for controlling the rate of cooling of metal bars, particularly relating to a cooling bed for receiving metal bars at elevated temperatures resulting from a continuous bar casting and/or rolling operation wherein the rate of bar cooling may be sufficiently retarded that a soft bar results having few internal stresses. The apparatus includes a bed receiving the hot bars at one end and conveyor means laterally transport the bars slowly across the bed, and the heat content on the conveyor is controlled by the bar spacing and speed and a thermal insulated heat barrier means disposed below and above the bed controls the rate of bar cooling wherein a substantially normalized bar exits at the bed discharge end. Control of the rate of cooling is a combination of regulating bar spacing, conveyor velocity and convection and radiation cooling control, and these factors are utilized to produce the desired bar physical characteristics, such as hardness.

4 Claims, 7 Drawing Figures

METAL COOLING BED FOR CONTROLLING RATE OF COOLING

PRIOR APPLICATION

This application is a continuation-in-part of Ser. No. 904,858, filed May 15, 1978 entitled Metal Cooling Bed For Controlling Rate Of Cooling, now abandoned.

BACKGROUND OF THE INVENTION

The invention pertains to cooling beds for heated cast metal bars whereby the rate of cooling may be closely regulated.

In the casting of metal bars, such as of steel, the steps basically include melting, casting, reheating, descaling, rolling, sawing to length, and cooling. These steps can be sequentially continuously performed with known apparatus, for instance, such as with rotational casters, and high production can be achieved with a minimum of equipment and investment.

However, one of the serious problems that has existed with known apparatus of this type lies in the inability in such a continuous processing system to accurately control the rate of heat transfer at the last metal cooling step so as to selectively produce a "soft" bar substantially free of internal stress and which has superior shearing and mechanical characteristics or a "hard" bar which has high wear resistance. Conventional cooling beds receiving the hot metal bars from the saw retain the bar upon conveyors open to the air, and by conduction, radiation and convection the bars will relatively rapidly cool at an uncontrolled rate, often resulting in a "hard" bar which cannot be readily sheared, when a "soft" bar is desired, and which is internally stressed because of the relatively rapid cooling.

In the conventional processing of ingots and bars internal stresses are relieved by normalizing the metal after leaving a cooling bed, and after the metal has substantially cooled. Such normalizing requires that the bars be reheated, and "soaked" in a soaking pit or other apparatus which permits the bars to slowly cool. Such reheating of the metal requires additional handling, extensive additional energy consumption and time, and a very expensive.

SUMMARY OF THE INVENTION

It is an object of the invention to provide a cooling bed for hot metal bars of elevated temperature residual from the bar casting process wherein the rate of bar cooling can be closely controlled and retarded to reduce the hardness of the bar and relieve internal stresses prior to the bar leaving the bed.

Another object of the invention is to provide a cooling bed for metal bars which may be incorporated into continuous bar processing systems, is capable of handling the production of a continuous bar processing system, is capable of closely controlling the rate of bar heat loss on the cooling bed, and wherein the rate of heat loss may be regulated.

An additional object of the invention is to provide a cooling bed for metal bars wherein the quantity of heat energy within the bars located on the bed may be accurately regulated and the rate of cooling controlled at a known rate to closely control the bar metal characteristics, and particularly control the cooling rate at the critical higher temperatures of metal transition.

Yet another object of the invention is to provide a modification of cooling bed for metal bars wherein a cooling water panel is substituted for an insulated heat barrier whereby the bars may be rapidly cooled to a wear resistant hardness and the rate of cooling accelerated with respect to conventional cooling beds.

In the practice of the invention a substantially horizontal cooling bed includes a bar receiving end, a bar discharge end and lateral sides. Bar conveying means is incorporated into the bed whereby hot metal bars may be placed upon the bed at the receiving end thereof and laterally translated slowly to the bar discharge bed end.

The rate of bar cooling upon the bed is a function of the time the bar is on the bed, the heat energy within the bars, the number (density) of bars on the bed and the rate of heat loss to the surrounding environment. In conventional cooling beds the rate of heat loss is relatively uncontrollable, and the temperature of the bars leaving the cooling bed is primarily controlled by the length of time that the bars are supported upon the bed. However, in the usual practice of the invention the rate of bar heat loss is retarded by locating a thermally insulated barrier directly below the bars and a second thermally insulated heat barrier is disposed directly above the bed and heated bars located thereon. Thus, the lower and upper insulated heat barriers confine the volume of air intermediate the barriers surrounding the bars, and permit the cooling of the bars to be retarded and regulated. If the distance of the upper heat barrier from the bed and bars is increased the volume of air between the barriers will increase, and the bars will cool at a greater rate than when the upper heat barrier is more closely disposed above the bars.

The upper heat barrier is preferably formed in at least two sections which are independently adjustable relative to each other and to the cooling bed. In a two section upper heat barrier, one section will extend from the bar receiving end approximately one-half the length of the bed in the direction of bar travel, while the other heat barrier section will cover the remaining bed half. Preferably, the upper heat barriers are mounted upon a plurality of vertically extending columns disposed adjacent the bed lateral sides, and the upper heat barriers are mounted to the columns by motorized elevating structure whereby the upper heat barriers may be vertically adjusted. By using four columns for each upper heat barrier section it is possible to orient the upper heat barrier sections as desired. It is also possible to locate the two heat barrier sections at different heights and such adjustment of the upper heat barrier will permit a variation in the rate of cooling as the bars travel along the bed to provide added versatility and control of the rate of bar cooling wherein the metallurgical characteristics of the bars may be very closely determined when cooling is completed. Also, it is contemplated that supplemental bar heating means be mounted on the upper heat barrier to add heat to the space above the bars wherein the rate of bar cooling may be further retarded, if desired, to additionally control the bar metallurgical characteristics.

A variety of conveyor devices can be used to laterally translate the heated bars through the cooling bed. In the disclosed embodiment a walking beam conveyor is shown which translates the bars across the fixed thermally insulated hearth of the bed by an indexing movement, the hearth defining the lower heat barrier. The type of conveyor used must be capable of controlling the spacing of the bars and the rate of movement of the bars through the cooling bed, and an indexing chain or endless conveyor could also be used.

While it is the basic purpose of the invention to provide a cooling bed for heated bars capable of retarding the cooling rate of such bars as compared to known apparatus, it is also desired that the bed be capable of rapidly cooling bars in the event a "hard" bar is desired for subsequent machining or application purposes. Accordingly, the cooling bed in accord with the invention may be provided with an upper water cooled panel in place of the upper insulated heat barrier whereby the panel is capable of rapidly dissipating the heat of the bars on the bed and bar cooling is accelerated to achieve desired metal characteristics.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
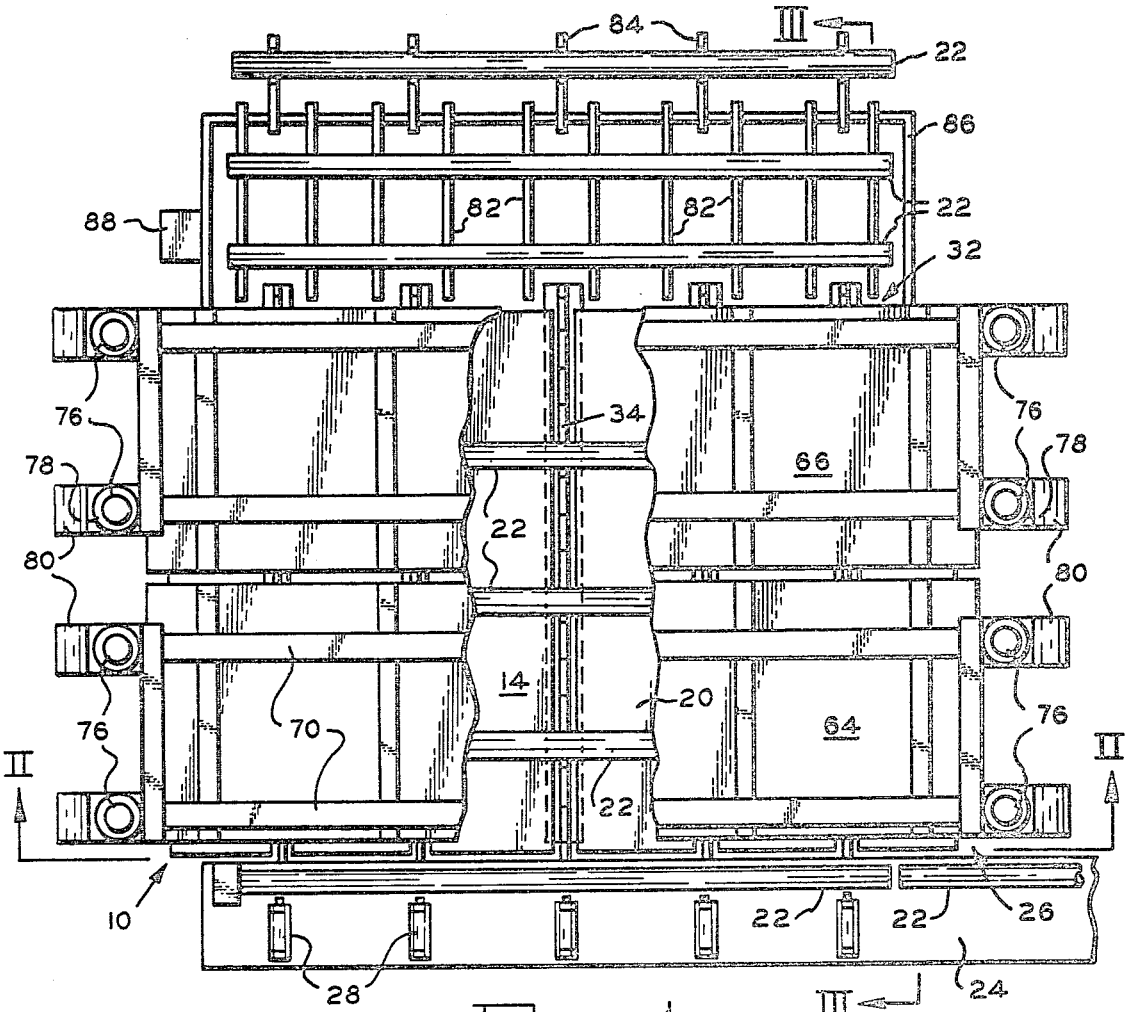
FIG. 1 is a top, plan view of a cooling bed in accord with the invention, partially sectioned, also illustrating the bar receiving table receiving bars from the cooling bed.

A cooling bed in accord with the invention comprises the last unit or station in a continuous processing sequence for metal bars. Typically, such a process includes a melting furnace, a bar caster which may be of the rotary type, reheating means for producing a substantially uniform heat throughout the bar lengths after casting, descaling, dimensional rolling and sizing, sawing to length, and cooling. Such apparatus, except for the cooling bed, does not form a part of the instant invention and is not illustrated, however, it is to be understood that the cooling bed generally indicated at 10 would normally receive the bars that have been sawn to length and are still in a highly heated state.

The cooling bed structure includes hearth support base blocks 12 capable of supporting great weight, and may consist of a concrete foundation, or the like.

The hearth 14 consists of a plurality of separated flat hearth sections 16 which extend the length of the bed, and are mounted upon the hearth support blocks 12 by a plurality of I-beams 18 extending the length of the hearth sections. The hearth 14 is thereby affixed against relative movement, and the hearth sections 16 include an upper flat surface 20 adapted to receive the bars 22 deposited upon the cooling bed. The hearth sections 16 are formed of a rigid thermally insulated material such as insulating firebrick on expanded metal grating or a cast material or ceramic fiber whereby heat transfer downwardly through the hearth occurs slowly, and the hearth is of sufficient strength to bear the weight of the number of bars 22 which are in the process of being cooled.

The cooling bed 10 receives the heated metal bars 22 from the sawing apparatus on a conveyor 24 disposed adjacent the bed bar receiving end 26, and the conveyor apparatus includes a plurality of unloading pusher cylinders 28 which selectively transfer the heated bars from the conveyor to the cooling bed at the end 26. Operation of the pusher cylinders will directly deposit the heated bars 22 upon the hearth sections upper surface 20 for transport thereacross by the bed conveyor 30, as described below.

Figure 2:
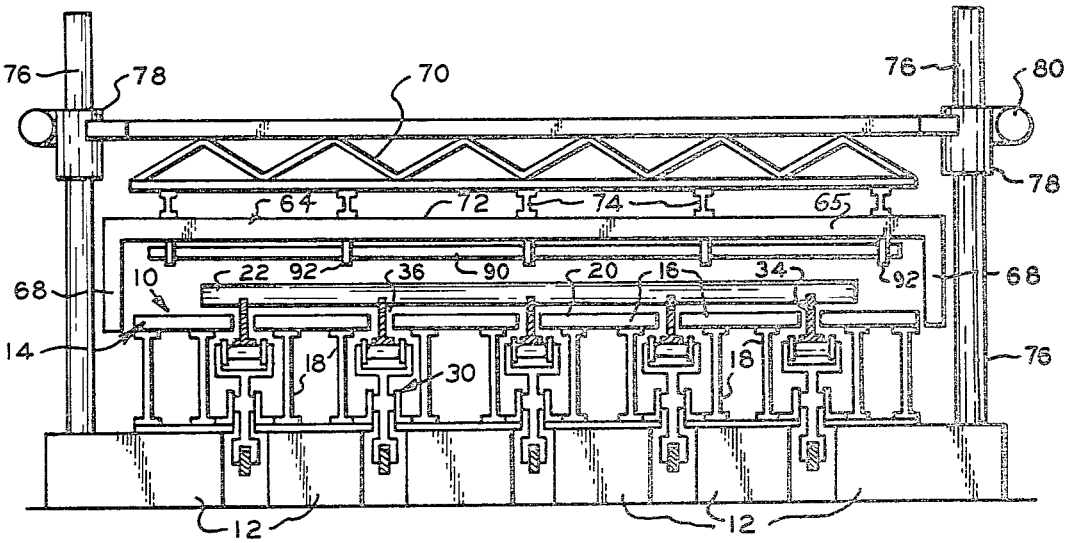
FIG. 2 is an elevational sectional view of the cooling bed as taken along Section II—II of FIG. 1.
Figure 4:
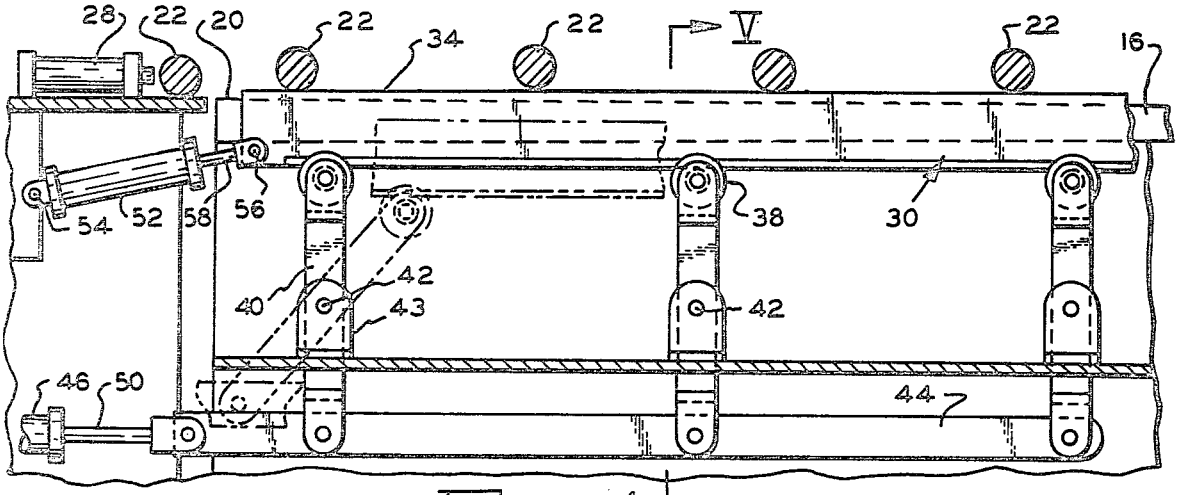
FIG. 4 is an enlarged, detailed, elevational sectional view as taken through the upper and lower heat barriers and illustrating the conveyor structure as taken along Section IV—IV of FIG. 5.
Figure 5:
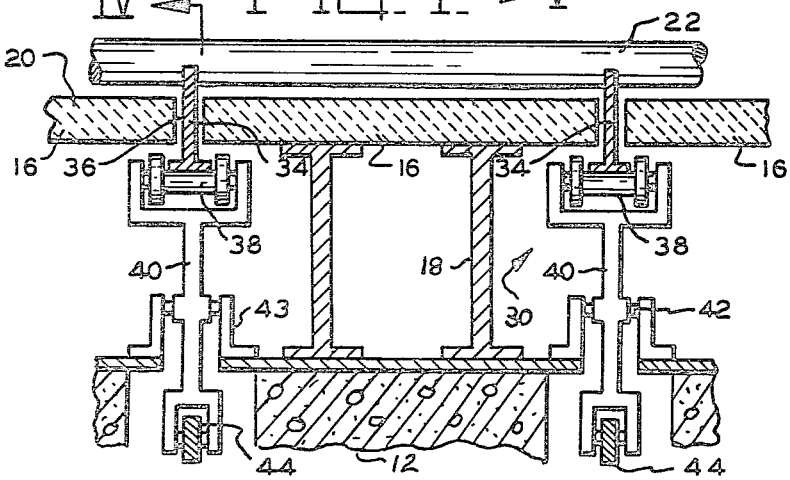
FIG. 5 is a detail elevational sectional view taken along Section V—V of FIG. 4.

The heated bars are slowly transported across the hearth 14 from the bed bar receiving end 26, to the bed bar discharge end 32, and in the disclosed embodiment this conveyor is of a walking beam type. The conveyor includes a plurality of elongated parallel beams 34 each located in the gap 36 separating adjacent hearth sections 16. Each beam is supported by a plurality of rollers 38 which are rotatably mounted at the upper end of levers 40. The levers 40 are pivoted on a pin 42 mounted in brackets 43 which are supported on base blocks 12, FIG. 2, and the lower end of the levers associated with a common beam 34 are pivotally interconnected by an operating bar 44 translatable in an axial direction by expansible motor 46. The motor 46 is pivotally supported at 48 and the piston 50 thereof is pivotally connected to bar 44 to permit the motor to accommodate itself to the change in elevation of the bar as the levers 40 are oscillated. Retraction of piston 50 will rotate levers 40 clockwise, FIG. 4, to the dotted line position to lower the supported beam 34, and extension of the piston will position the levers 40 as in FIG. 4 where the beam 34 will be elevated to the maximum extent.

The beams 34 are each axially translatable on rollers 38 by an expansible motor 52 pivotally supported at 54 at an elevation equidistant between the elevated and retracted beam positions and pivot 56 connects piston 58 to the associated beam. The upper edge of the beams 34 are flat and when the piston 50 is retracted to pivot levers 40 clockwise the associated beams are lowered below hearth surface 20 as shown in the dotted lines in FIG. 4.

The bars 22 are moved through the cooling bed 10 from end 26 to discharge end 32 by the sequential raising, lowering and axial translation of the beams 34 which operate in unison. When piston 50 is retracted to lower beam 34 below surface 20 the piston 58 can then be retracted to shift the beam to the left, FIG. 4, without disturbing the bars 22 resting on hearth surface 20. Piston 50 is then extended to raise the beam to the full line position of FIG. 4 which lifts the bars 22 from surface 20. The piston 58 is now extended to the right which indexes the bars to the right, FIG. 4, toward end 32. The extent of axial movement of the beams 34 will be primarily determined by the rate of cooling desired as the spacing between the bars significantly determines the heat density or content on the cooling bed at a given time. The piston 50 is then retracted to lower the bars onto the hearth surface 20 and the cycle is repeated at the desired time interval. Operation of the motors 46 and 52 is usually automatic, accomplished by conventional timed controls, not shown, and such controls form no part of the present invention.

To control the rate of cooling of the bars 22 upon the cooling bed 10, it is also necessary to isolate the bars from the environment above the bars in order to retard cooling by radiation, conduction and convection, as well as below, as provided by the insulated hearth sections 16. For this purpose an upper heat barrier 62 is disposed over the hearth 14, and this upper heat barrier extends the length and the width of the cooling bed structure. Preferably, the upper heat barrier 62 is formed in a plurality of sections, two sections being illustrated in the disclosed embodiment, namely the front section 64, and the rear section 66, so designated in view of their proximity to the direction of bar movement through the bed.

The thermally insulated upper or roof barrier sections 64 and 66 are identical, and each includes a horizontal portion 65 extending over the hearth bed and formed at its lateral edges with downwardly extending walls 68 whereby the hearth sections will be substantially enclosed by the upper heat barrier sections thereabove and at the lateral sides. As will be appreciated from the drawings, the length of the sections 64 and 66 in the direction of movement of the bars 22 is substantially one half of the bed length, and thus the upper heat barrier 62 extends throughout the length of the cooling bed 10.

Each of the upper heat barrier sections 64 and 66 are supported upon truss members 70 which prevent sagging and provide adequate reinforcement of the upper heat barrier sections. The upper heat barriers may be formed of a variety of thermal heat insulating materials, such a ceramic fiber available under the trademark "Kaowool," or the like, and may include internal reinforcing cores and an upper cover 72 to which the supporting truss is affixed by I beam brackets 74. As the "width" of the cooling bed 10 may well be in excess of 20 feet the necessity for the supporting truss 70 will be appreciated.

The upper heat barrier web supporting trusses 70 are mounted upon a plurality of columns 76 located at the lateral sides of the cooling bed 10. The columns 76, four being used to support each upper barrier section, each receive a collar 78 which is slidably mounted on the associated column and is vertically adjustable thereon. Each of the collars 78 includes an electric motor drive 80 mounted thereon which cooperates with column mounted structure, such as a threaded shaft or a toothed rack, not shown, whereby energizing of the electric motor in one direction or the other will selectively raise or lower the associated collar. The collars 78 support the trusses 70 and the motors 80 of each barrier section 64 and 66 are so wired that all four motors for a section may be simultaneously operated in like directions to maintain the sections parallel to the bed hearth 14.

After the bars 22 have proceeded through the cooling bed 10, and have been slowly cooled to a temperature which permits them to be exposed to ambient air without adverse results, the bars are deposited upon rails 82 wherein the bars are permitted to cool in ambient air. Thereupon, the bars are moved to the bundling cradles 84 by conveyor means associated with rails 82, not shown, wherein several bars may be bound together for handling purposes, and are removed from the cradles to storage or shipping.

It may be desirable to accelerate the rate of bar cooling at the rails 82 and to such end an air chamber 86 is defined below rails 82 into which ambient air is forced by fan 88 which forces air up through the rails and the bars 22 resting thereon to rapidly cool the bars before being transferred to the cradles. Such cooling will not harden the bars since the bars have cooled below the critical metallurigical temperatures.

In operation, prior to receiving a particular run of bars 22 to be cooled, the upper heat barrier sections 64 and 66 will be vertically adjusted with respect to the hearth surface 20 by the motors 80 to produce that degree of confinement of the heated bars desired so as to control the rate of cooling. Of course, the rate of cooling is also determined by the heat energy confined as determined by the temperature of the bars and the number of bars on the cooling bed at a time, as well as the rate the bars are conveyed through the cooling bed, and as these variables are under the control of the operator the rate of cooling may be closely regulated.

After the bars 22 are sawn they are moved to the conveyor 24, and are pushed from the conveyor 24 by pusher cylinders 28 onto the hearth surface 20 when the beams 34 are disposed below the hearth surface. At this time, the bars will be at an elevated temperature which is substantially uniform throughout the bar length. As the bars are placed upon the hearth surface 20 they will be laterally moved into the space between the hearth surface and the front upper heat barrier section 64, and the confining of the bar between the lower barrier as defined by the hearth, and the upper barrier, substantially retards bar cooling by reducing both the bar radiation losses, and the losses by conduction and convection which normally take place to the ambient air. However, it will be appreciated that the hearth 14 and heat barriers 64 and 66, though insulated, will slowly transfer heat and the heat of the bars will be dissapated through the heat barriers. Thus, the bars will slowly cool as they are moved moved through the cooling bed, and the rate of cooling using the cooling bed of the apparatus approaches the rate attained by the steel industry using a secondary normalizing procedure which requires reheating and slow cooling in a soaking pit or the like. The rate of cooling provided by the bed of the invention reduces the internal stresses within the bars resulting in fewer defects in the bars and in the products formed from the bars, and bars cooled in accord with the invention have excellent shearing and machining characteristics without requiring additional normalizing by heating and soaking.

Figure 3:
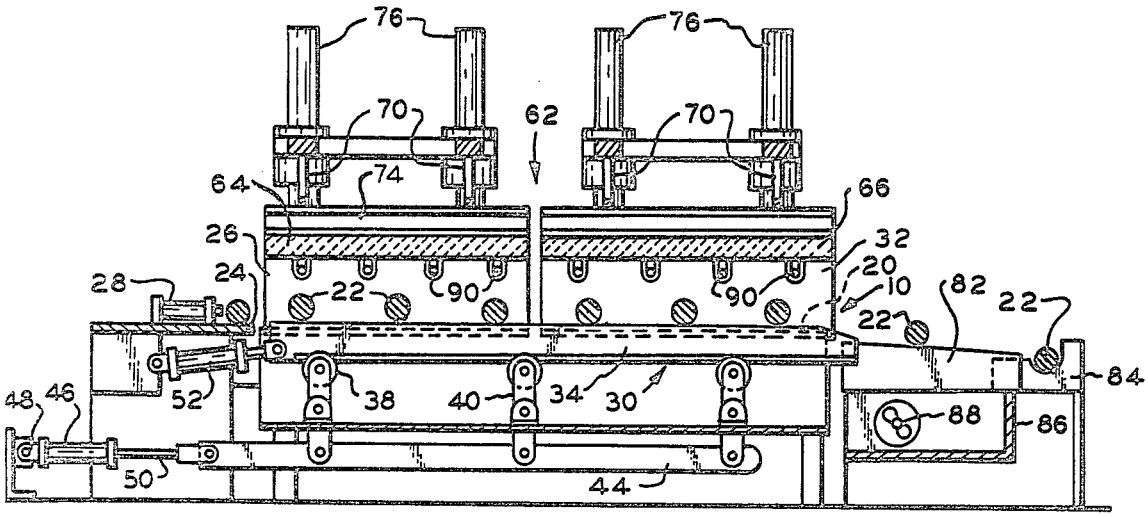
FIG. 3 is a side elevational view of the cooling bed of FIG. 1 as taken along Section III—III thereof.

In some instances it may be desirable to retard the rate of bar cooling even greater than that achievable by sole use of the heat barriers formed by the hearth and sections 64 and 66, and increasing the number of bars upon the cooling bed, and slowing the rate of bar translation by the beams 34. Accordingly, it is contemplated that supplemental heating means be located upon the cooling bed in such a location as to retard the rate of bar cooling, and as shown in the drawings, such heating means may take the form of elongated electric resistance heating rods 90 mounted upon the underside of the barrier sections 64 and 66, as will be appreciated from FIG. 3. The heating rods 90 may be of the Calrod type, and are mounted by appropriate hangers 92 to the associated upper barrier. Since the heating rods are located directly above the bars 22 the heat thereof will be radiated toward the bars, and thereby aid in retarding the rate of cooling of bars 22. Of course, it will be appreciated that such supplemental heating means could take the form of gas or oil fired heat elements, such as firetubes, located above the hearth surface 20 in a relationship similar to that achieved by rods 90.

Figure 6:
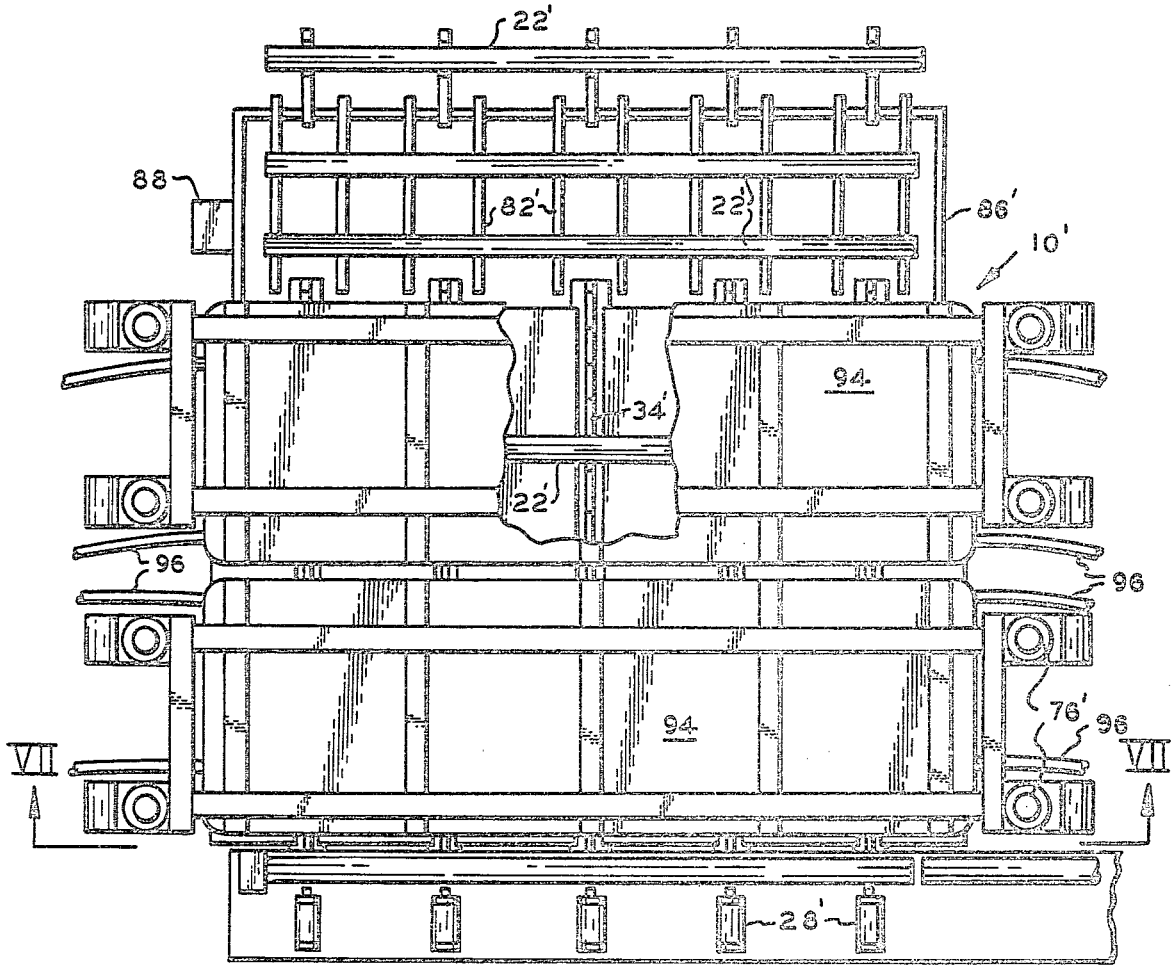
FIG. 6 is a top plan view of a modification of cooling bed in accord with the invention utilizing a water cooled panel, a portion of the rear waterpanel being broken away for purpose of illustration.
Figure 7:
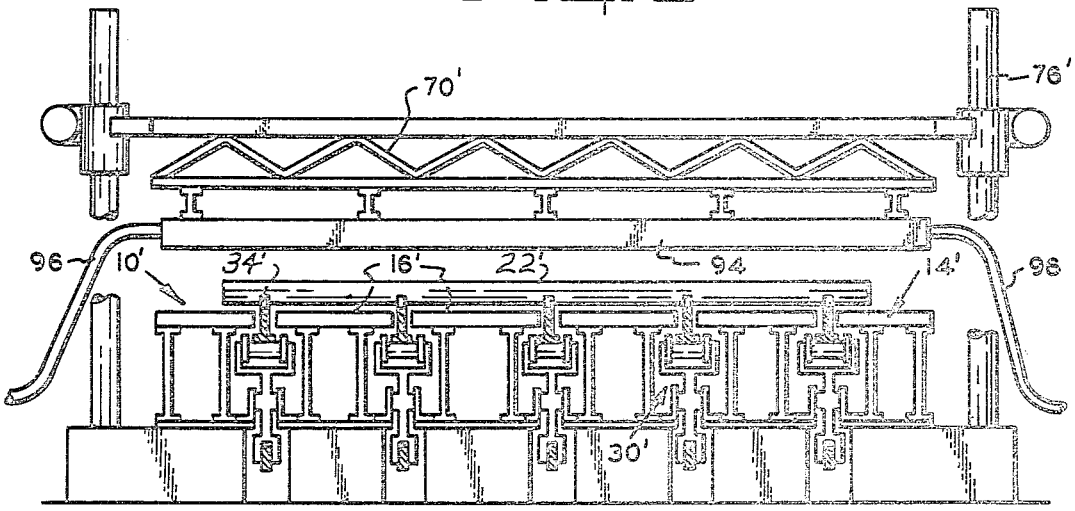
FIG. 7 is an elevational sectional view of the embodiment of FIG. 5 as taken along VII—VII thereof.

In FIGS. 6 and 7 an embodiment of a cooling bed utilizing concepts of the invention is illustrated, and except for the construction of the front and rear upper heat barriers the cooling bed apparatus is identical to that previously described, and components thereof are indicated by similar primed reference numerals.

In the embodiment of FIGS. 6 and 7 the front and rear upper heat barrier is in the form of a panel 94 constituting a tank or reservoir filled with a circulating water wherein the heat barrier comprises a heat exchanger which may be maintained at a relatively cool temperature. The panels 94 are of an elongated rectangular configuration as will be appreciated from FIG. 6, and hose lines 96 communicate with the ends of the tanks through which cooling water may be circulated to carry off the heat absorbed by the tank from the bars 22′ being translated through the cooling bed 10′. The hose lines 96 are connected to water supply and drainage or cooling devices of conventional nature, not shown, and by the use of a cooling tower, or the like, the cooling water may be recycled.

The water panels 94 will be disposed above the bars 22′ mounted upon beams 34′ at a distance which will permit the panels to absorb the heat of the bars 22′ at an accelerated rate sufficient to cause a "hard" bar to be produced on a production basis. The rate of cooling is sufficient to produce a wear resistant surface upon the bars 22′, and bars processed by the cooling bed of FIGS. 6 and 7 may be utilized in those applications wherein a wear resistant surface is desired, such as for grinding bars used in ore processing.

It will be appreciated that various types of conveyors may be used with the cooling bed of the invention, and the walking beam type of conveyor illustrated is only one of many conveyor arrangements that would be suitable. For instance, endless chain type conveyors could be employed wherein the bars 22 are deposited upon chains, and the chain movement is indexable.

As previously stated, the rate of bar cooling is controlled, in addition to the position of upper heat barriers, by the heat content or density present on the cooling bed. This heat content is regulated, primarily, by the spacing between the bars placed on the cooling bed, and the rate that the bars are moved across the bed. The extent of movement of piston 58 controls the bar spacing, and the intervals between cycling of motors 46 and 52 will regulate the rate of bar movement.

Where it is desired to have a slow rate of bar cooling the bars 22 will be spaced close together, the rate of bar movement will be slow and the upper heat barrier 62 will be lowered to locate the heat barrier close to the bars. Where cooling is to take place at a more rapid rate the bars may be spaced further apart, the rate of bar movement increased and the heat barrier 62 raised.

As the bar spacing and rate of movement may be greatly vaired, and the position of the upper heat barrier infinitely adjusted within its limits of travel, all or any one of these variables may be adjusted to control the cooling rate. Of course, the rate of bar movement must be sufficient to permit the bed to accept bars at a rate at least equal to that at which the bars arrive at the cooling bed, and by designing the bed length commensurate with the bar forming apparatus with which it is used and the range of cooling rates contemplated, the cooling bed will be capable of continuously accepting and cooling the formed bars resulting in a continuous cooling process having a greater capacity for metal treatment than prior bar cooling apparatus.

It will therefore be appreciated that a cooling bed in accord with the invention permits the continuous cooling of bars manufactured in a continuous bar processing system, and the cooling bed permits the bars to be cooled at a rate which will result in the desired degree of bar hardness. When using a heat insulating upper barrier the rate of bar cooling may be retarded such that the bars are substantially normalized upon being discharged from the cooling bed, and in a continuous manner "soft" bars may be produced having excellent shearing and machining characteristics which do not require subsequent reheating, soaking and normalizing or annealing. The bars received upon the conveyor 24 and introduced into the cooling bed 10 may be approximately 1500° F., and as the cooling occuring on the bed is such as to lower the bar temperature below the critical metallurigical range in a controlled manner a high bar output can be maintained wherein the residual heat of the bar fabrication is used in the normalizing procedure resulting in significant energy savings as compared with conventional metal heat treating processes to control bar hardness.

The use of auxiliary heaters 90 in conjunction with the upper insulating heat barriers provides additional control over the rate of bar cooling and the apparatus of the invention provides a versatility of control of the rate of bar cooling not heretofore achievable.

It is appreciated that various modifications to the inventive concepts may be apparent to those skilled in the art without departing from the spirit and scope of the invention.

I claim:

1. Apparatus for controlling the rate of cooling of individual heated metal bars comprising, in combination, a substantially horizontal bed having a bar receiving end, a bar discharge end and lateral sides, said bed including an indexable conveyor extending between said bed ends adapted to receive and support metal bars to be cooled by laterally translating the bars from said bar receiving end to said bar discharge end, conveyor operating means connected to said conveyor for selectively varying the spacing between adjacent bars and varying the rate of movement of said bars across said bed, said bed including a first thermally insulated heat barrier disposed below said conveyor, a second heat transfer control barrier spaced vertically above said conveyor and superimposed over said bed, vertically extending columns located adjacent said bed lateral sides, and adjustable support means supporting said second barrier upon said columns at an operative predetermined height directly above said bed wherein the height of said second barrier above said bed aids in regulating the rate of heat loss from said bars.

2. Apparatus for controlling the rate of cooling of heated metal bars as in claim 1, wherein said second barrier is defined by first and second sections, said first section being superimposed over substantially one-half of said bed from said bar receiving end and said second section being superimposed over the remaining bed half to said bar discharge end, said adjustable support means independently supporting said first and second sections for selective vertical adjustment relative to each other and said bed.

3. Apparatus for controlling the rate of cooling of heated metal bars as in claim 1 wherein said second heat barrier comprises a metal water cooled panel, water circulating means communicating with said panel, said panel rapidly removing heat from the heated bars in said bed to cool said bars at a rate to procure a wear resistant surface.

4. Apparatus for controlling the rate of cooling of heated metal bars as in claim 1, supplemental heaters mounted on said second heat transfer control barrier located between said second barrier and said bed selectively adding heat to the space between said first and second barriers to retard the cooling of heated bars located upon said bed.

* * * * *